United States Patent [19]

Ragnebring

[11] Patent Number: 4,506,613

[45] Date of Patent: Mar. 26, 1985

[54] HEMMER

[75] Inventor: Chris Ragnebring, Borås, Sweden

[73] Assignee: Akab of Sweden AB, Borås, Sweden

[21] Appl. No.: 495,530

[22] Filed: May 17, 1983

[30] Foreign Application Priority Data

May 27, 1982 [SE] Sweden ..... 8203288

[51] Int. Cl.[3] ..... D05B 35/02

[52] U.S. Cl. ..... 112/143

[58] Field of Search ..... 112/141-143

[56] References Cited

U.S. PATENT DOCUMENTS

| | | | |
|---|---|---|---|
| Re. 29,758 | 9/1978 | Rockenath et al. | 112/141 |
| 2,138,633 | 11/1983 | Greenfield et al. | 112/141 |
| 2,279,588 | 4/1942 | Enos | 112/143 X |
| 2,647,479 | 8/1953 | Gentillo | 112/143 |
| 4,003,323 | 1/1977 | Crawford et al. | 112/141 |

*Primary Examiner*—Werner H. Schroeder
*Assistant Examiner*—Andrew M. Falik
*Attorney, Agent, or Firm*—Holman & Stern

[57] ABSTRACT

A hemmer intended for making double-folded hems by feeding a fabric edge through the device comprising at least a folding edge, a main bar and a folding rule arranged at a distance above the main bar. The main bar front end being bevelled and designed to fold the fabric edge around the folding rule with the hem edge located between the main bar and the folding bar and in its second, rear part the main bar being designed with an upfolded, longitudinal edge section which partly is arranged to extend along and over the rear longitudinal edge of the folding bar and partly is bevelled at its front section. The hemmer in one embodiment may be adjusted to fold hems of different widths and hems which already have transverse hems.

7 Claims, 16 Drawing Figures

HEMMER

BACKGROUND OF THE INVENTION

1. Field of the Invention

The present invention relates to a hemmer for providing double folded hems by feeding a fabric edge through the apparatus.

2. Description of the Prior Art

A hemmer of the above mentioned type is normally designed as a helical, taper sleeve, which by itself produces an acceptable double-folded hem, but which can be used for only one hem width and for fabrics having a specific thickness. Further, it is not possible to sew a hem across an existing hem.

BRIEF SUMMARY OF THE INVENTION

An object of the present invention is to provide a hemmer, which may be easily changed so that hems of different widths can be sewed. A further object is to provide a simple and relatively cheap device which has a good reliability in operation and which treats the fabric softly. A third purpose is to make it possible to sew fabrics which already are provided with transversel hems. These objects have been achieved by the invention which includes at least two folding rails a main bar and a folding rule arranged at a distance above the main bar. The mainbar rail is in its front end bevelled and designed to fold the fabric edge around the folding rule with the hem edge located between the folding bars. The second, rear part of the mainbar is designed with an upfolded, longitudinal edge section which partly is arranged to extend along and over the rear longitudinal edge of the folding rule and partly is bevelled at its front section.

The invention will now be described in greater detail with reference to the accompanying drawings wherein.

Figure 1:
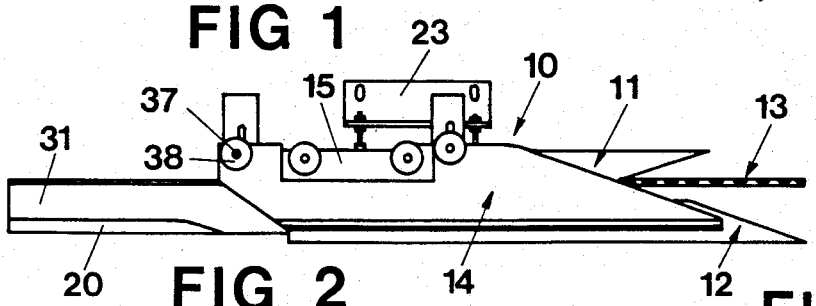
FIG. 1 is a top plan view of the hemmer according to the invention.
Figure 2:
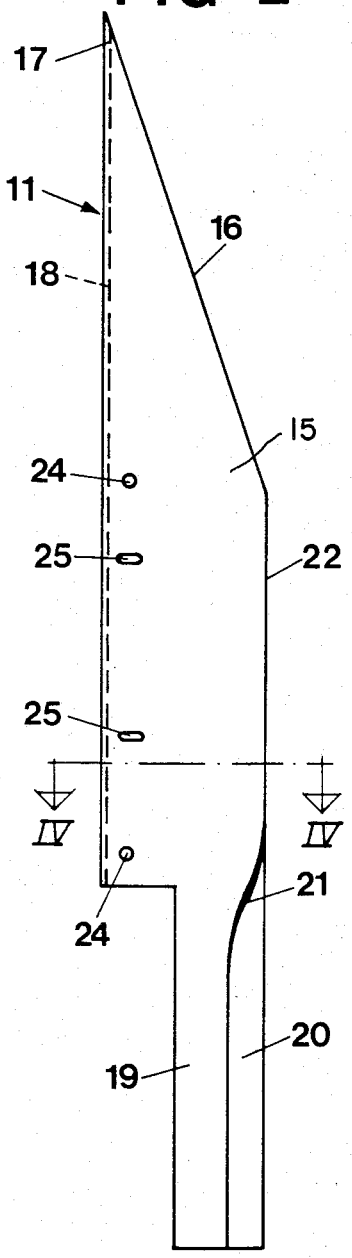
FIG. 2 is a top plan view of the main bar included in the hemmer according to FIG. 1.
Figure 3:
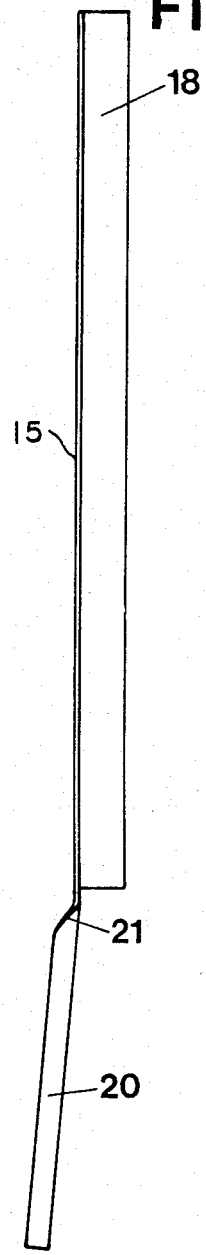
FIG. 3 is a side elevational view of the main bar according to FIG. 2.
Figure 5:
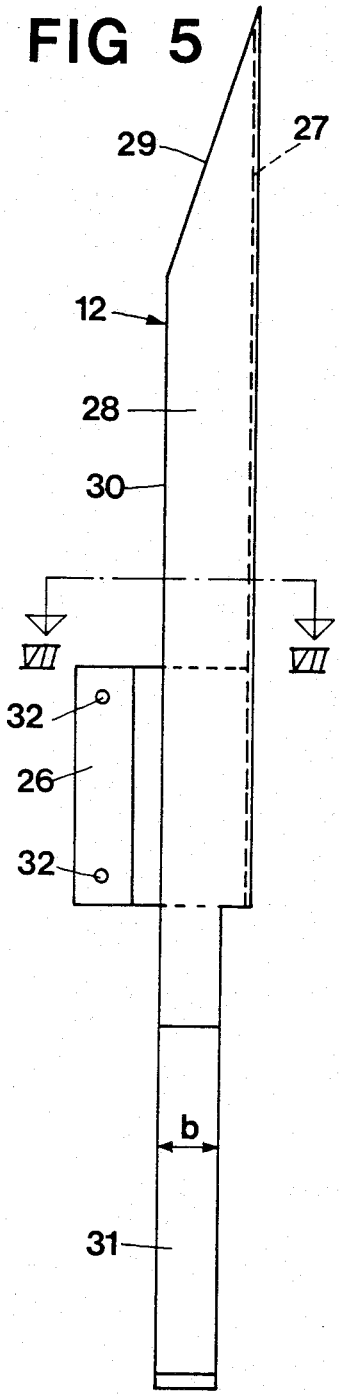
FIG. 5 is a top plan view of a folding rule which is included in the hemmer according to FIG. 1.
Figure 6:
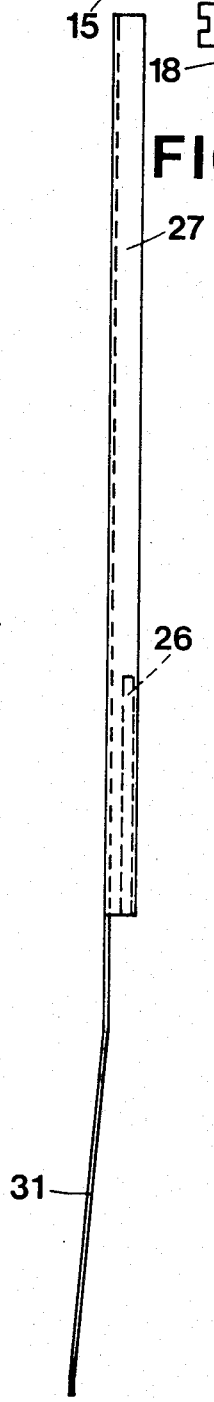
FIG. 6 is an elevational view of the folding rule according to FIG. 5.
Figure 7:
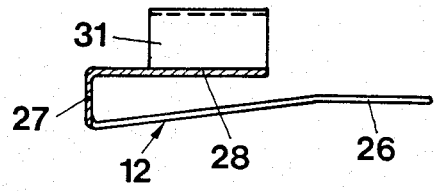
Figure 8:
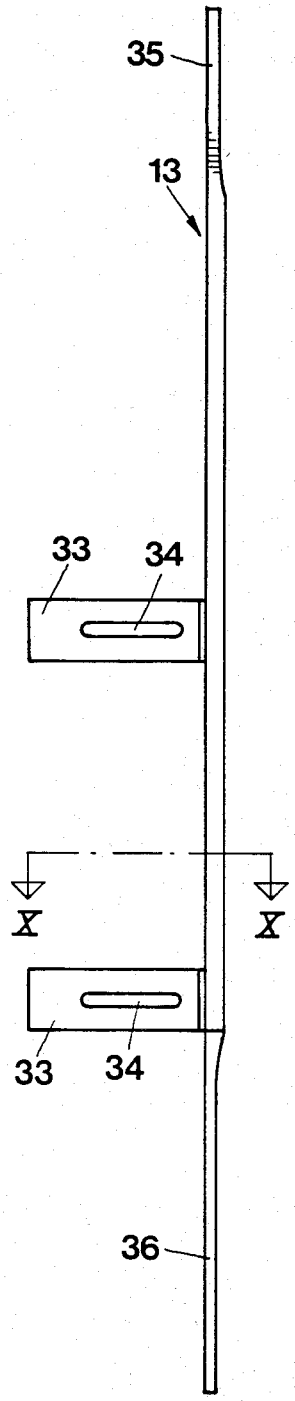
Figure 9:
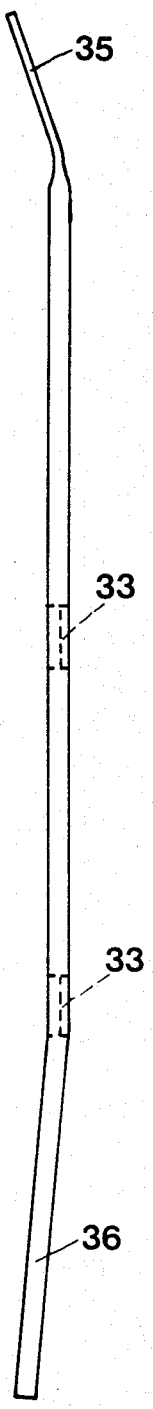
Figure 10:
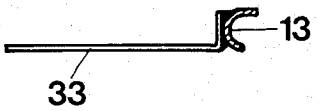
Figure 11:
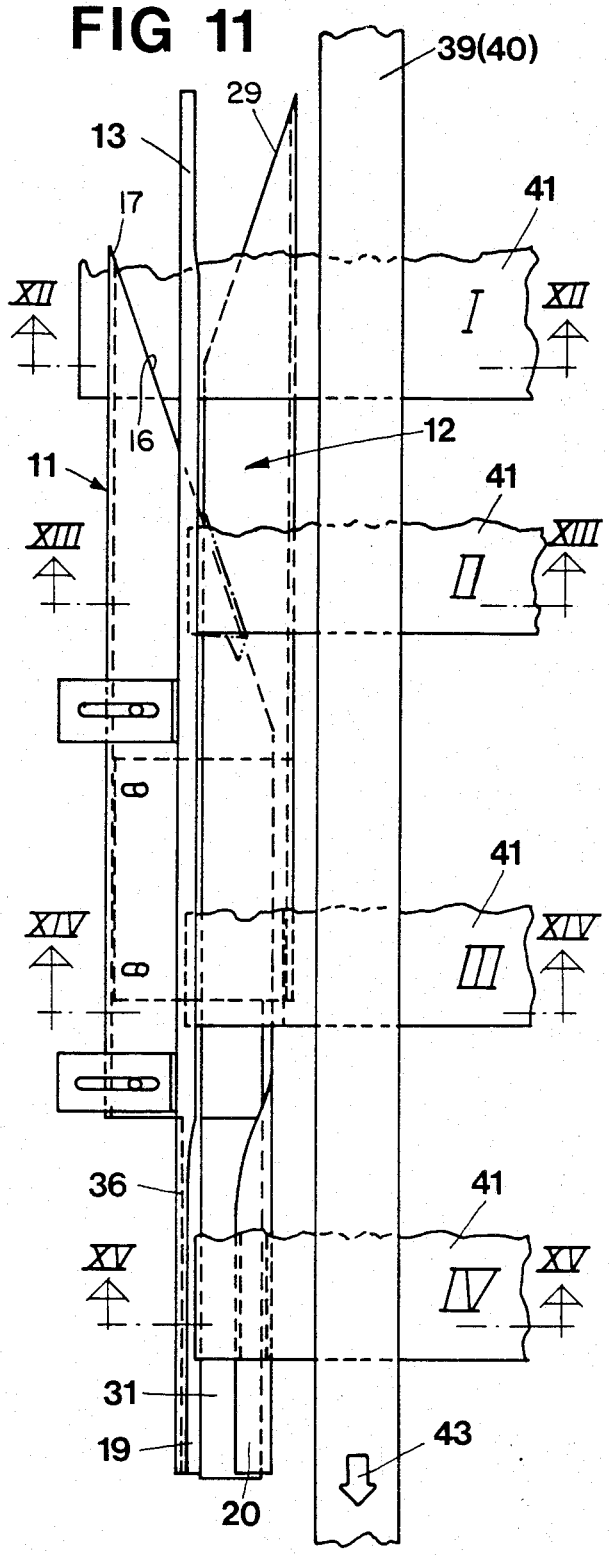
Figure 15:
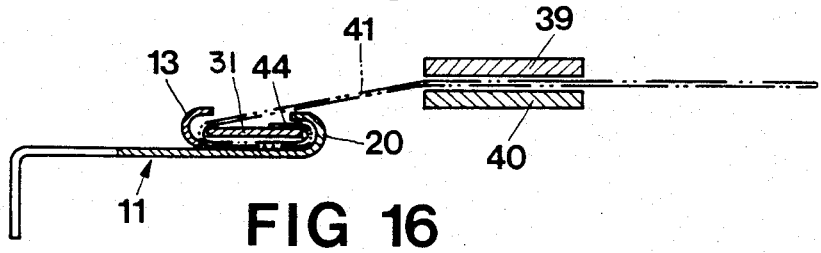
Figure 16:
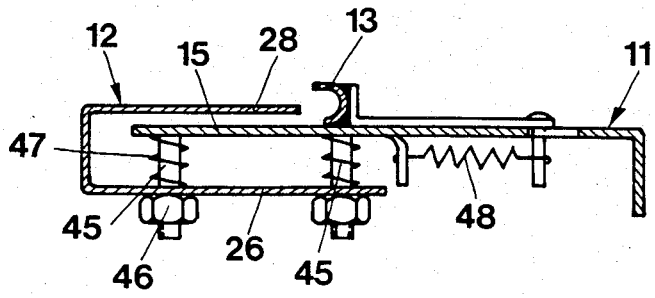

FIG. 7 an enlarged cross-sectional view taken along line VII—VII in FIG. 5;

FIG. 8 is a top plan view of an edge rail included in the hemmer according to FIG. 1;

FIG. 9 is a side elevational view of the edge rail of FIG. 8;

FIG. 10 is a cross-sectional view taken along line X—X in FIG. 8;

FIG. 11 is a top plan view of the hemmer without a protection rail and with inserted fabric edge during different folding phases;

FIGS. 12–15 are cross-sectional views taken along lines XII—XII, XIII—XIII, XIV—XIV and XV—XV, respectively of FIG. 11 showing the fabric edge in different folding phases; and FIG. 16 is a cross-sectional view through a modified hemmer according to the invention.

DETAILED DESCRIPTION

The hemmer 10 consists essentially of four parts, a main bar 11, a folding rule 12, an edge bar 13 and a protection rail 14. Since the last mentioned device mainly only has a protective function it will henceforth be omitted in the disclosure of the hemmer.

Figure 4:
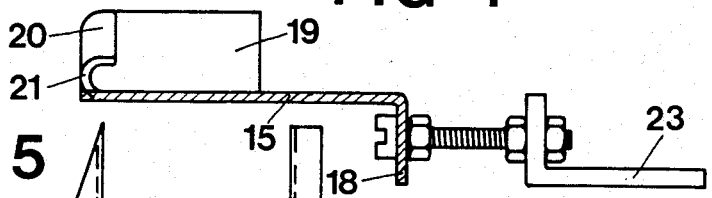
FIG. 4 is a cross-sectional view taken along line IV—IV in FIG. 2.

The main bar 11 consists of a plate profile which has an L-formed cross section; the rib planar part 15 of which is arranged essentially horizontally and the front end of which is bevelled. This bevelled end 16 extends to a straight tip 17 located at the flange 18 of the main bar. The rear section 19 of the main bar 11 is along the edge which is remote from the flange 18, provided with an upfolded longitudinal edge section 20, which in its front section is provided with a bevelled part 21, which provides a gradual passage from the front edge 22 of the main bar. The rear section 19 of the main bar is in some degree slightly bent upwards in the front of the bevelled part 21. As can be seen in FIG. 4 the upfolded longitudinal edge section 20 has an arch in its cross section.

To the flange 18 there is connected a bracket 23 by means of which the hemmer may be connected to a frame, i.e. a machine (not shown). At the horizontal part 15 of the main bar are arranged holes 24 and 25 intended for mounting of folding rule 12 and edge bar 13 respectively.

The folding rule 12 has essentially the same length as the main bar 11 and is arranged at some distance above it. By means of an attachment 26, which forms an extension of a vertical flange 27 of the folding rule which in cross section is essentially L-formed, the folding rule is detachably connectable to the underside of the main bar 11. The horizontal section 28 of the folding rule 12, is at its front end bevelled in such a way that the bevelled part 29 is facing the bevelled part 16 of the main bar. The folding edge 30 of the folding rule 12, which is remote from the flange 27, extends uninterrupted to the rear end of the rule. The rear section 20 of the rule is at the middle of the upfolded edge section 20 of the main bar designed somewhat narrower than the section 28 and its width is determining for the width of the hem. The rear section 21 is in the same manner as the rear section 19 of the main bar bent somewhat upwards. In the mounted condition of the main bar and the folding rule 12 the rear section 31 of the folding rule will partly be located below the upfolded end section 20 of the main bar. The clamp-like attachment 26 is designed and mounted to the underside of the main bar in such a way, that the section 28 is located at some distance from and parallel to the horizontal section 15 of the main bar. The holes 32 located in the attachment 26 correspond to the holes 24 located in the main bar.

The edge bar 13 is in its mounted position located close to the folding edge 30 of the folding rule 12 and has for this purpose essentially the same length. The edge bar has a curved cross section and is provided with two attachments 33, which are provided with oblong holes 34, corresponding to the holes 25 in the main bar 11. The front section 35 of the edge rail 13 is bent slightly upwards, as can be seen in FIG. 9 and its rear end section 36 has essentially the same angled position as the rear section 31 of the folding ruler and the rear section 19 of the main bar. The attachment 33 is mounted to the horizontal section 15 of the main bar by means of screws 37 and knob-like nuts 38.

THE FUNCTION OF THE HEMMER

Parallel to the hemmer 10 two endless conveyor belts 39 and 40 are arranged, of which only two belt sections contacting each other are shown (see FIG. 11). A fabric edge 41, which is intended to be provided with a hem, is transported between the belts 39 and 40 towards the hemmer and before arrives it will pass through a cutting device (not shown), where the fabric edge 42 is cut clean.

Figure 12:
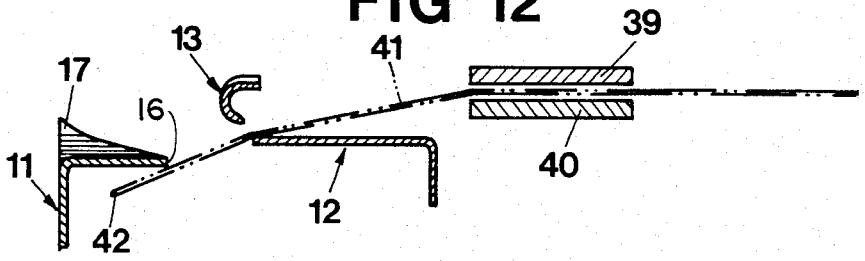
Figure 13:
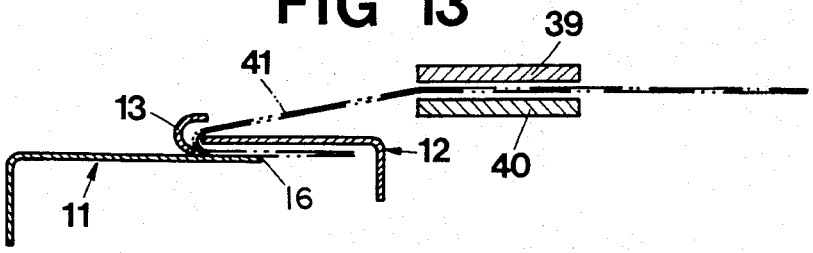
Figure 14:
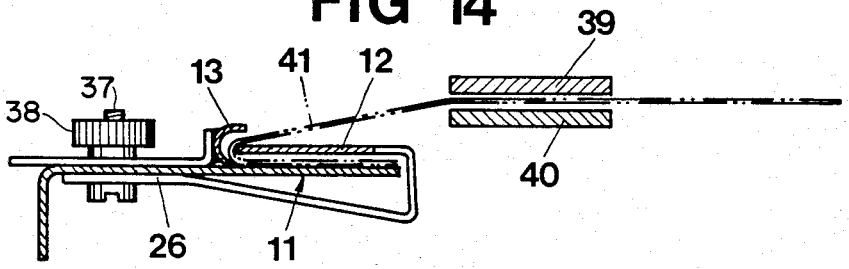

The front sections of the main bar 11, the folding rule 12 and the edge bar 13 are formed in such a way that when the fabric edge 41 is fed into the hemmer 10, it will be located above the folding rule 12, but below the edge bar 13 and the main bar 11, as is shown in FIG. 12. At a continued feed from position I in FIG. 11 to the position II the fabric edge will be folded over the folding edge 30 of the folding rule 12, in such a way that a part of the fabric edge will be located below the folding rule 12, as is shown in FIG. 13. The edge section 13 supports the outer surface of the fold at the same time so that the folding is done as exactly as possible.

When the fabric edge 41 has reached the position III in FIG. 11, the folding rule 12 continues in the more narrow rear section 31, at the same time as the main bar 11 supports the entire folded fabric edge. If the belts 39 and 40 continue to transport the fabric edge in the direction of the arrow 43 the outermost edge section 44 of the fabric edge 41 will be folded upwards on the folding rule 12, by the rear section of the main bar which continues in the upfolded longitudinal edge section 20 as is shown in FIG. 15. The upfolding of the edge section 44 of the fabric edge is possible, since the fabric between the belts 39 and 40 and the hemmer 10 is kept at a distance through the edge section 20.

The hem shaping is thereby finished and the conveyor belts 39 and 40 transport the folded hem to a sewing machine (not shown) arranged in direct connection to the hemmer.

In case a narrower or wider hem is desired the folding rule 12 only need be removed and replaced by one with the desired width b at the rear section 31. The edge bar 13 may, because of the oblong holes 34, be adjusted in a way so that it will be located in an exact position in relation to the folding edge 30 of the folding rule.

A great problem has until now been connected to the hemming of fabric pieces, which already are provided with a transversal hem, since by their thickness are very difficult and in many cases impossible to press through conventional hemmers. The modified embodiment in FIG. 16 shows a simple design of the above disclosed hemmer which may be adapted to sudden changes in thicknes of the fabric edge. The clamp shaped attachment 26 of the folding ruler 12 is designed with somewhat larger distance to the horizontal section 28 of the rule. The main bar 11 is provided with control pins 45 at the underside, said pins passing through corresponding holes in the attachment 26, and said pins 45 control the upward and downward motions of the folding rule. The outer ends of the control pins 45 are threaded and provided with nuts 46 and at every control pin a compression spring 47 is arranged between the main bar and the clamp-shaped attachment 26.

In a similar way as the folding rule 12 is vertically movable the edge bar 13 is horizontally movable against the action of a spring 48 on the underside of the main bar 11.

If a fabric edge which earlier has been provided with a hem is being fed into the hemmer according to FIG. 16 the folding rule 12 is flexibly moving as much as required to allow the thicker section to pass between the horizontal section 15 of the main bar and the corresponding section 28 of the folding rule. In the same way the edge bar 13 may be moved in the direction away from the folding rule in such a way that space for the passage of the hem is provided. The invention is not limited to the shown and disclosed embodiments but a number of embodiments are possible within the scope of the claims.

I claim:

1. A hem forming device for forming double-folded hems along a lateral edge of a material as the material is fed forwardly through the device comprising:

an elongated substantially flat main bar having substantially straight and parallel inner and outer edges and a planar section and a first bevelled material entry edge at one end portion extending between said inner and outer edges, and a longitudinal curved section extending along said inner edge at the other rear portion curving back upon said main bar forming a concave folding surface facing toward said outer edge and having a bevelled entrance edge portion extending from said inner edge;

a substantially flat elongated folding rule having a folding inner edge and an outer edge and extending substantially parallel to said main bar in spaced relationship thereto, said inner edge of said folding rule extending substantially parallel to said inner and outer edges of said main bar, and a second bevelled material entry edge at one end facing oppositely to said first bevelled entry edge, said folding rule overlapping said main bar with the inner folding edge of said folding rule passing over said first bevelled edge between the ends thereof; and a rear section on said folding rule having an inner edge continuous with said inner edge of said folding rule and a folding outer edge extending in adjacent spaced relation to said concave folding surface with the plane of said rear section passing through said concave surface;

so that the lateral edge of the material fed through said first and second bevelled edges of the device will be folded by said first bevelled edge downwardly and around and upwardly into the space between said main bar and folding rule at the overlapping part, and thereafter folded upwardly around said outer folding edge of said rear section of said folding rule and onto the top surface of said folding rule by said concave folding surface at the rear portion of said main bar.

2. A hem forming device as claimed in claim 1 and further comprising:

an elongated edge bar extending along and substantially parallel to said inner folding edge of said folding bar having a curved cross-sectional configuration with a concave surface facing said inner folding edge and positioned in spaced relation with respect thereto with the plane of said folding rule passing through said concave surface of said edge bar;

so that the material folded over said inner folding edge passes through the space between said concave surface of said edge bar and said inner folding edge.

3. A hemmer as claimed in claim 2 and further comprising: means for adjustably mounting said folding rule and said edge bar on said main bar so that said inner edges of said main bar and folding rule are adjustable with respect to each other and said edge bar is adjustable with respect to said inner folding edge of said folding rule.

4. A hemmer as claimed in claim 3 wherein said adjustable mounting means are automatically adjustable and comprise:

bolt members connecting said folding rule to said main bar so that said folding rule is movable in a direction toward and away from said main bar, and spring means resiliently urging said folding rule toward said main bar; and means for slidingly mounting said edge bar on said main bar and spring means resiliently urging said edge bar toward said inner folding edge of said folding rule;

so that when the thickness of the material fed through the device increases, said folding rule and said edge bar will be moved by the material automatically to adjust the spacing between the folding rule and the main bar and between the concave surface of the edge bar and the inner folding edge of the folding bar.

5. A hemmer as claimed in claim 1 or 2 wherein: the rear portions of said main bar, folding bar and edge bar extend slightly upwardly from the planes of the entrance portions of these respective parts, and said entrance portion of said edge bar extends at a slight upward angle from the position wherein it is disposed with the concave surface thereof adjacent said inner folding edge of said folding rule.

6. A hemmer as claimed in claim 1 and 2 and further comprising: means for detachably mounting said folding rule on said main bar.

7. A hemmer as claimed in claim 1 or 2 and further comprising: means for adjustably mounting said folding rule on said main bar so that said inner edges are adjustable with respect to each other.

* * * * *